United States Patent [19]

Heynau et al.

[11] Patent Number: 4,562,769

[45] Date of Patent: Jan. 7, 1986

[54] SPATIALLY MODULATED, LASER AIMED SIGHTING SYSTEM FOR A BALLISTIC WEAPON

[75] Inventors: Hans A. Heynau, Norwalk; Charles F. Hoover, Ridgefield, both of Conn.

[73] Assignee: United Technologies Corporation, Hartford, Conn.

[21] Appl. No.: 565,494

[22] Filed: Dec. 27, 1983

[51] Int. Cl.[4] ..... F41G 3/06

[52] U.S. Cl. ..... 89/41.06; 356/152

[58] Field of Search ..... 89/41.06; 244/3.13, 244/3.16

[56] References Cited

U.S. PATENT DOCUMENTS

| | | | |
|---|---|---|---|
| 2,409,462 | 10/1946 | Zworykin et al. | 89/41.07 |
| 2,459,206 | 1/1949 | Wheeler | 89/41.05 |
| 3,339,457 | 9/1967 | Pun | 89/41.06 |
| 3,548,212 | 12/1970 | Whetter | 250/253 |
| 3,575,085 | 4/1971 | McAdam | 89/41.06 |
| 3,766,826 | 10/1973 | Solomonsson | 89/41.06 |
| 3,840,794 | 10/1974 | Clement et al. | 318/632 |
| 3,845,275 | 10/1974 | Branson | 235/61 |
| 3,881,824 | 5/1975 | Higgins | 356/141 |
| 3,900,175 | 8/1975 | Eckerstrom et al. | 244/3.13 |
| 3,997,762 | 12/1976 | Ritchie et al. | 235/61.5 |
| 4,011,789 | 3/1977 | Bresee, Jr. et al. | 89/41.21 |
| 4,027,837 | 6/1977 | Miller, Jr. et al. | 244/3.16 |
| 4,028,991 | 6/1977 | Kuby | 89/41.06 |
| 4,094,225 | 6/1978 | Greenwood | 89/41.06 |
| 4,173,414 | 11/1979 | Vauchy et al. | 356/152 |
| 4,266,463 | 5/1981 | Saltin | 89/41.22 |
| 4,501,399 | 2/1985 | Loomis | 244/3.13 |

OTHER PUBLICATIONS

R. J. Mongeon, B. B. Silverman, W. J. Green, Jr., "*$CO_2$ Laser Radar for the CSAR Helicopter,*" United Technologies Research Center, May 1980.

*Primary Examiner*—Stephen C. Bentley

*Attorney, Agent, or Firm*—Richard P. Lange; Robert P. Sabath

[57] ABSTRACT

A precision weapon aiming system used in conjunction with an optical radar for a weapon includes a pattern projector mounted to direct preselected optical pulses along the boresight of the weapon. A boresight receiver in the optical radar generates quadrature signals in response to radar returns reflected from the target. The azimuth and elevation of the weapon is varied until the magnitude of the quadrature signals are equal, thereby aligning the weapon boresight on the target.

1 Claim, 2 Drawing Figures

SPATIALLY MODULATED, LASER AIMED SIGHTING SYSTEM FOR A BALLISTIC WEAPON

DESCRIPTION

1. Technical Field

This invention relates to a precision laser aimed system for a ballistic weapon.

2. Background Art

Various types of radar systems have been developed which identify targets and direct weapon systems toward the selected targets. Some of these fire control systems include a laser radar to direct the weapon to its intended target. Some of these weapon guidance systems may use a laser radar to identify and direct the weapon.

Weapon delivery systems which include lasers are known. For example, L. Bresse, Jr. et al. U.S. Pat. No. 4,011,789 issued Mar. 15, 1977 for "Gun Fire Control System" includes a laser range finder mounted on a gun turret to measure the target range. M. Kirby U.S. Pat. No. 4,028,991 issued June 14, 1977 for "Weapon System" discloses a weapon system utilizing a laser to determine the relative position of the weapon with respect to the target. The optical system is responsive to the reflected beam and utilizes the return signals to determine the relative position of the weapon and the target. Another gun fire control system utilizing a laser is described in L. Kendy U.S. Pat. No. 3,845,276 issued Oct. 29, 1974 for "Laser-Sight and Computer for Anti-Aircraft Gun Fire Control System". The gunner's sight unit contains a laser-type optic system which, in conjunction with a fire control computer, computes the lead angles necessary in azimuth and elevation and provides output to servos which direct the gun fire.

Of particular interest is a paper entitled "Multifunction Coherent $CO_2$ Laser Radar For Airborne Tactical Operations" by R. J. Mongeon presented at the IRIS Conference in October 1980. This article describes an airborne $CO_2$ laser radar system which is mountable in a helicopter and well suited for detecting terrain, small wires and other obstacles at sufficient range to permit avoidance.

DISCLOSURE OF INVENTION

It is an object of the laser aimed precision sighting system for a ballistic weapon to provide highly accurate boresight tracking of a target.

An advantage of the laser aimed precision sighting weapon system according to the present invention is that it is well suited for orienting a ballistic weapon toward a target with a high degree of accuracy.

A particular advantage of the spatially modulated laser aiming sighting system according to the present invention is that the weapon mounting from which the ballistic weapon is launched only requires an easily ruggedized optical transmitter directed along the weapon boresight. Optical radar return signals from far field patterns are received through the acquisition radar and demodulated through a heterodyne receiver.

The foregoing and other objects, features and advantages of the present invention will become more apparent from the following description of preferred embodiments and accompanying drawing.

BEST MODE FOR CARRYING OUT THE INVENTION

Figure 1:
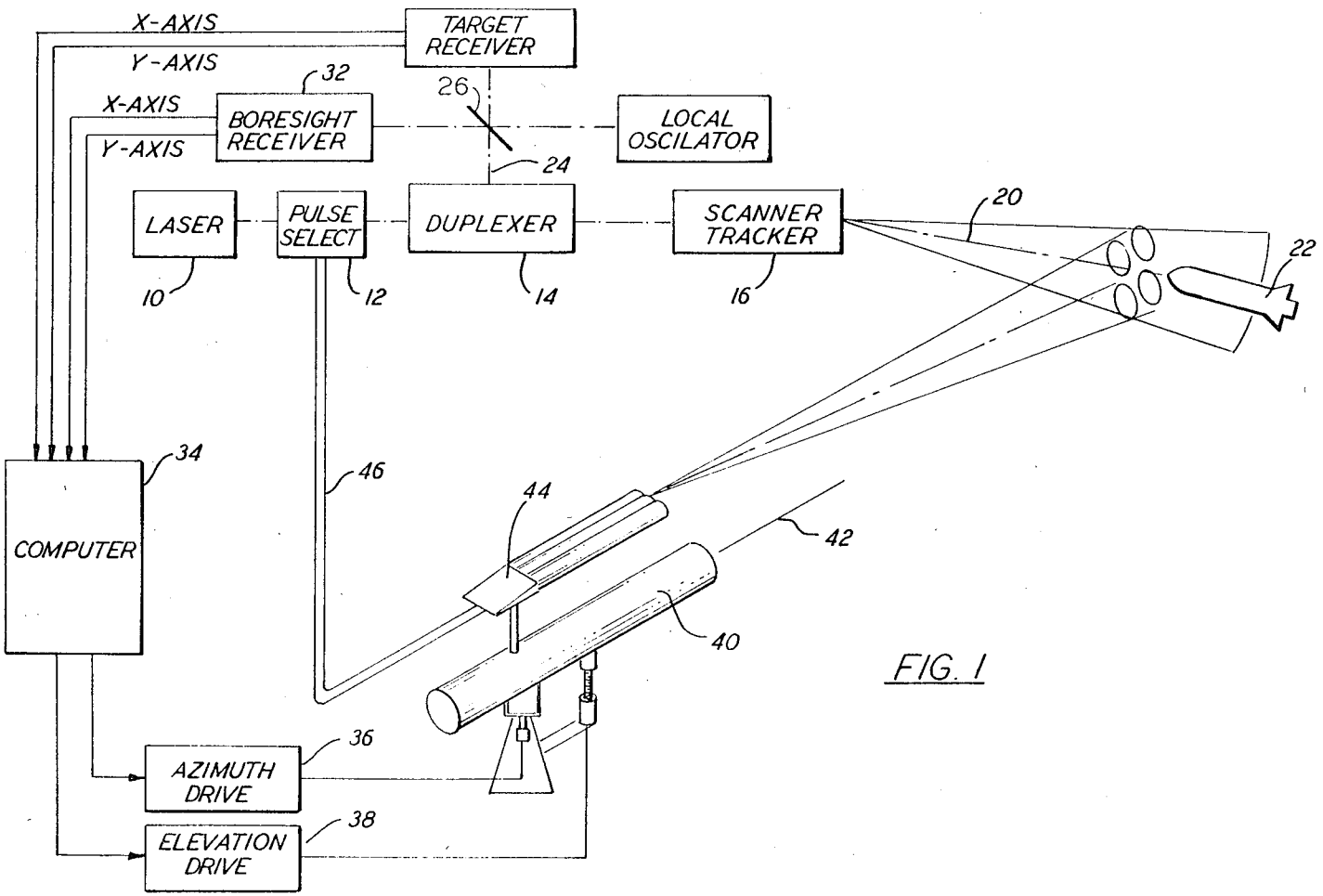
FIG. 1 illustrates one embodiment of the laser aimed precision sighting system according to the present invention.

Referring initially to FIG. 1, there is seen one embodiment of the laser aimed precision sighting system according to the present invention for causing the highly accurate boresight tracking by weapon 40. The system has two modes of operation, both of which function simultaneously, one is a conventional scan/track mode of the optical radar while the other is a precision aiming mode. A laser 10, such as a high PRF $CO_2$ laser, generates s series of optical pulses which pass through a pulse selector 12, a duplexer 14 to a scanner/tracker 16 where they are directed to a particular field of view, such as indicated by a beam axis 20. A portion of the optical energy striking a target 22 is reflected back along the beam axis 20 to scanner/tracker 16 back to the duplexer 14 where it is directed along an axis 24 to a beam splitter 26. The beam is combined at the beam splitter with a reference beam from a local oscillator 28, such as a $CO_2$ laser, and the combined beams directed to a conventional target receiver 30 that is associated with a laser radar and also to a boresight receiver 32 (the latter device being explained in greater detail hereinafter). The target receiver 30 responds to signals from the tracker/scanner and, in conjunction with a computer 34, generates range, azimuth and relative motion signals related to the target 22. As is known, this information might then be used, in a rough manner, to control an azimuth drive 36 and an elevation drive 38 through a conventional servo system to point the weapon 40 for engaging the target 22. With the exception of the boresight receiver 30 and the pulse selector 12, the foregoing optical radar system, as broadly described, is well known in the art.

The optical radar system as just described uses the angular information of the beam axis 20, the time relationship between optical pulses, as well as doppler effects of the returns to determine range, azimuth and relative motion of the target 22. In a weapon control system this information is used, either automatically or manually, to point the weapon 40 for engaging the target 22. The problem with the prior art weapon systems is that they may not be sufficiently accurate to direct the weapon 40 along the exact azimuth that will engage the target 22, i.e., the system has inherent inaccuracies. Accordingly, if the precise aiming direction 42 of the weapon 40 with respect to the target 22 can be accurately identified, the precise direction of fire can be calculated by the computer 34 using well-known ballistic algorithms.

The precision weapon sighting system of the present invention resolves the foregoing problem by the simultaneous course tracking and fine boresight correction of the weapon 40. The course control is by the conventional optical radar system and the fine control is by a highly accurate technique of continuously varying boresight 42 of the weapon 40 to track the target 22. The present invention provides for a pattern projector 44 which can be rigidly mounted on, and aligned with, the boresight 42 of the weapon. One embodiment of the pattern projector 44 could be a conventional lens with four optical waveguides 46 located near its focal point. The optical waveguides 46 extend from the pulse selector 12 so that certain pulses from the laser 10 can be sequentially coupled to each of the waveguides forming the pattern projector 44. Optical energy reflected from the target 22 along the axis 20 is received by the tracker/scanner 16 and passes through the optical train consisting of the duplexer 14 and the beam splitter 26 where a portion of the returns is coupled into the boresight receiver 32.

Figure 2:
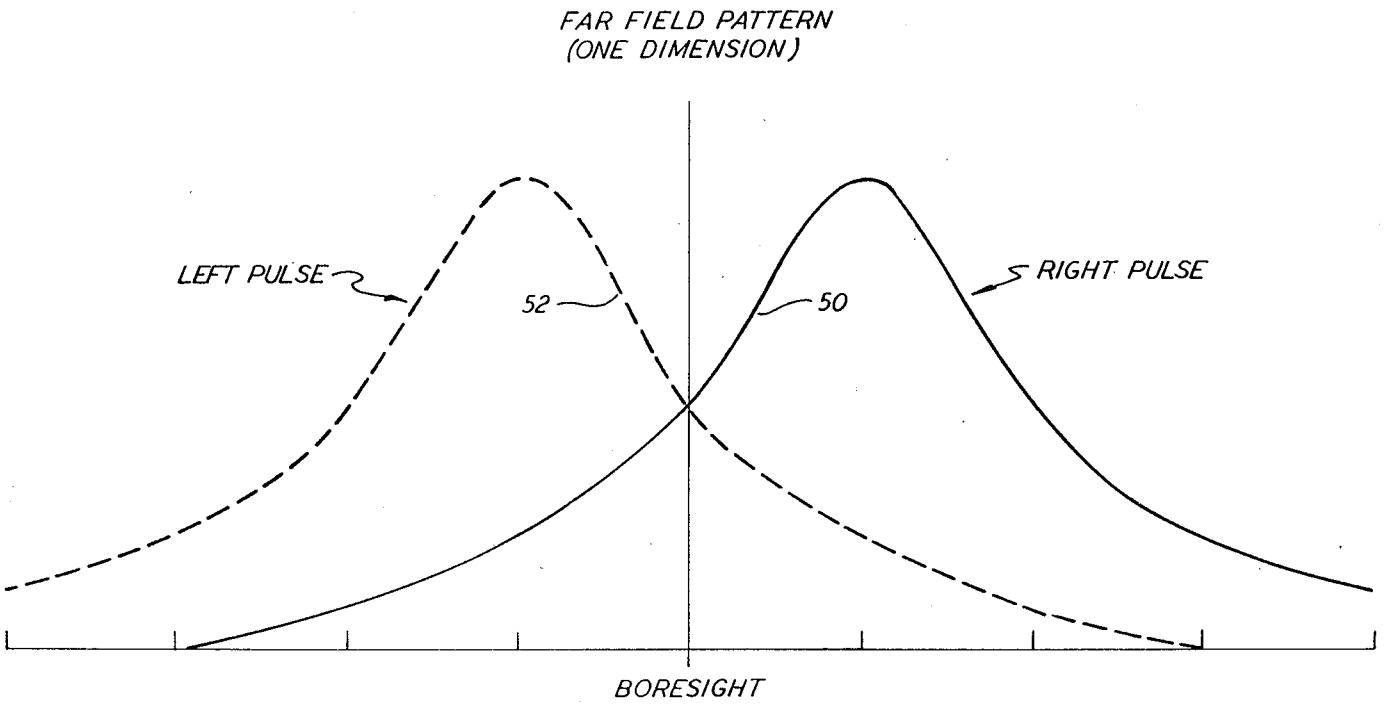
FIG. 2 shows output signals from the boresight receiver illustrating that the signals are balanced when the weapon is on boresight to the target.

Referring additionally to FIG. 2, there is seen a typical far afield pattern which would exist at the location of the target 22. The boresight receiver senses the strength of the return signals to identify different received signal strength. For example, in azimuth, the strength of the signal received in the right quadrature is compared to the signal 52 received in the left quadrature. If not equal, the computer 54 adjusts the azimuth drive 36 in the direction to increase the weaker of the two signals and decrease the stronger until the strength of the received signal from each quadrature is the same. Once this is done in both azimuth and elevation, as generally shown in FIG. 2, the boresight 42 of the weapon 40 is precisely pointed toward the target 22.

For the purposes of clarity, the target receiver 30 and the boresight receiver 32 have been shown in the drawing as separate components. In the construction of the laser aiming system according to the present invention, most likely part, if not all, of the hardware related to these components would be common to both devices and the computer performing the subroutines on the radar returns would be identifying and processing the subroutines as above described.

As is well known, in the tracking of a target with a ballistic weapon, it is often desirable to have the weapon boresight 42 lead the target. This lead could be easily calculated by the computer 34 and included in the control signal fed to the azimuth drive 36 and the elevation drive 38.

Although this invention has been shown and described with respect to a preferred embodiment, it will be understood by those skilled in this art that various changes in form and detail thereof may be made without departing from the spirit and scope of the claimed invention.

We claim:

1. A precision weapon aiming system for accurately orienting the boresight of a weapon toward a target, comprising:

an optical source for generating a series of illuminating pulses;

optical scan means for directing said illuminating pulses along a first axis which is scanned over a transmit field of view, and for receiving pulses reflected by said target in a receive field of view;

firest receiver means for providing direction signal associated with the orientation of said first axis;

pattern projector means mounted to direct a preselected series of optical pulses in a quadrature format along a second axis, said second axis being colinear with the boresight of said weapon;

second receiver means positioned to receive return optical signals from said optical scan means, and for providing quadrature signals in which the relative magnitude thereof is indicative of the orientation of said second axis;

pulse selector means for coupling preselected illuminating pulses along a quadrature waveguide to said pattern projector means, said pulse selector means being disposed between said optical source and said optical scan means; and means for redirecting the boresight of said weapon until said quadrature signals are equal thereby precisely and accurately orienting said boresight of said weapon on said target.

* * * * *